United States Patent [19]

Kircher

[11] 4,312,737

[45] Jan. 26, 1982

[54] ELECTRODE FOR MONOPOLAR FILTER PRESS CELLS

[75] Inventor: Morton S. Kircher, Clearwater, Fla.

[73] Assignee: Olin Corporation, New Haven, Conn.

[21] Appl. No.: 143,969

[22] Filed: Apr. 25, 1980

[51] Int. Cl.[3] ..... C25B 9/00; C25B 11/03

[52] U.S. Cl. ..... 204/257; 204/284; 204/288; 204/289

[58] Field of Search ..... 204/252–258, 204/263–266, 283–284, 279, 286, 288, 289

[56] References Cited

U.S. PATENT DOCUMENTS

| | | | |
|---|---|---|---|
| 3,963,596 | 6/1976 | Kircher | 204/258 |
| 4,056,458 | 11/1977 | Pohto et al. | 204/263 |
| 4,069,129 | 1/1978 | Sato et al. | 204/258 |
| 4,101,410 | 7/1978 | Kircher et al. | 204/282 |
| 4,210,516 | 7/1980 | Mose et al. | 204/257 X |

*Primary Examiner*—Andrew Metz

*Assistant Examiner*—Donald R. Valentine

*Attorney, Agent, or Firm*—James B. Haglind; Donald F. Clements

[57] ABSTRACT

An electrode for a monopolar filter press cell comprises two vertical foraminous surfaces positioned in parallel and spaced apart. A frame having two side members, a top member, and a bottom member is attached to the foraminous surfaces. A chamber is formed between the foraminous surfaces and bounded by the frame. Conductor rods pass through one of the side members into the chamber; the conductor rods being spaced apart from the foraminous surfaces. The frame has inlets and outlets for introducing fluids into and removing electrolysis products from the chamber. The novel electrodes provide improved gas flow patterns by creating limited restrictions within the chamber so as to generate a Venturi or low pressure effect which pulls gases from the interelectrode gap through the electrode surfaces and into the chamber.

14 Claims, 5 Drawing Figures

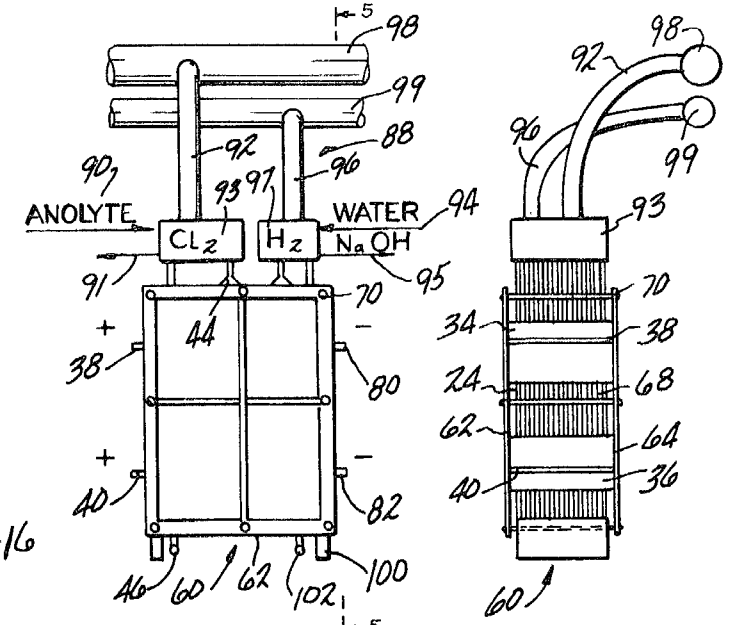
FIG-5
FIG-4
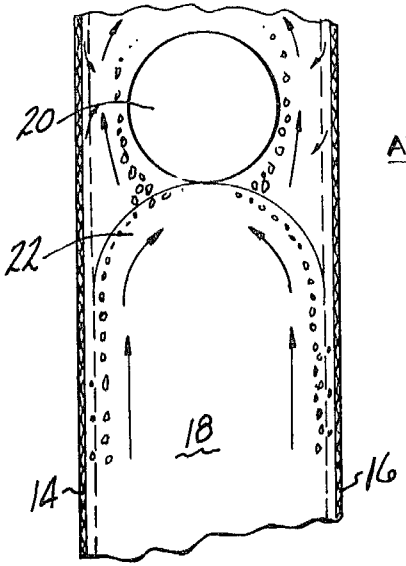
FIG-2
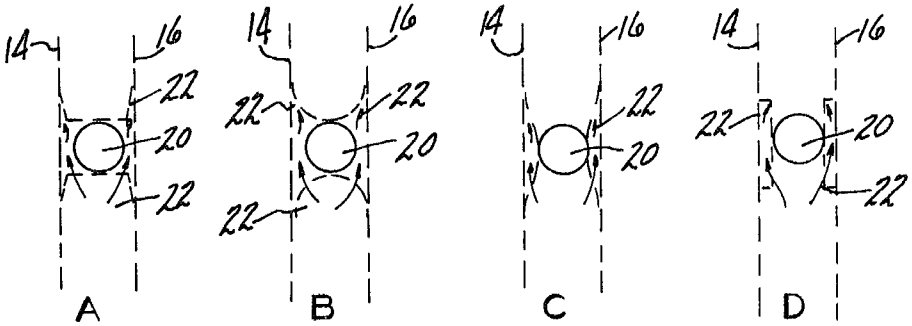
FIG-3
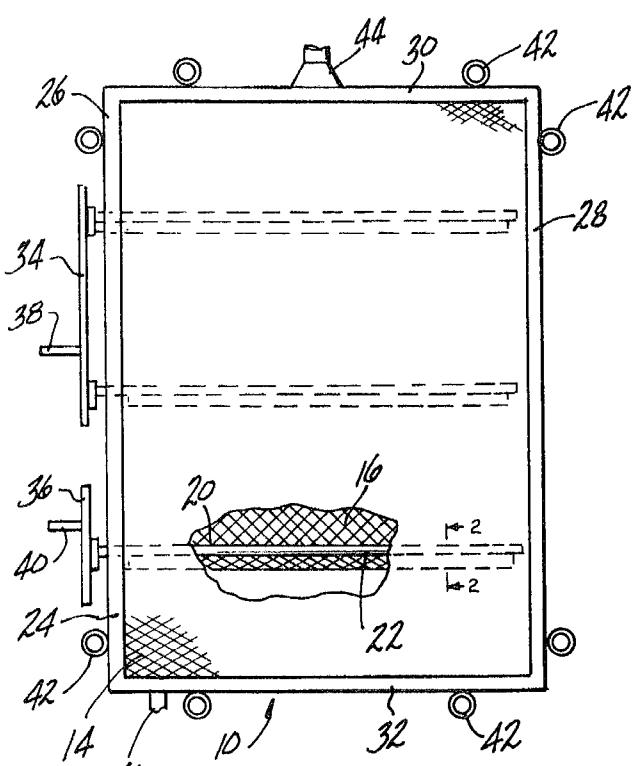
FIG-1

ELECTRODE FOR MONOPOLAR FILTER PRESS CELLS

This invention relates to electrodes for membrane type electrolytic cells and particularly to electrodes for monopolar filter press cells.

Commercial cells for the production of chlorine and alkali metal hydroxides have been continually developed and improved over a period of time dating back to at least 1892. In general, chloralkali cells are of the deposited asbestos diaphragm type or the flowing mercury cathode type. During the past few years, developments have been made in cells employing ion exchange membranes (hereafter "membrane cells") which promise advantages over either diaphragm or mercury cells. It is desirable to take advantage of existing technology particularly in diaphragm cells, but it is also necessary to provide cell designs which meet the requirements of the membranes. Since suitable membrane material such as those marketed by E. I. duPont de Nemours and Company under the trademark Nafion® and by Asahi Glass Company Ltd. under the trademark Flemion® are available principly in sheet form, the most generally used of the membrane cells are of the "filter press" type. In the filter press type cell, membranes are clamped between the flanges of filter press frames. Filter press cells are usually of the bipolar type. Bipolar filter press cells have been found to have several disadvantages, such as (a) corrosion between connections from anodes to cathodes through the separating plate; and (b) electrical leakage from one cell to another through inlet and outlet streams.

Furthermore, bipolar cell circuits designed for permissible safe voltages of about 400 volts are small in production capacity and are not economical for a large commercial plant. The failure of one cell in a bank of bipolar filter press cells normally requires shutting down the entire filter press bank.

Filter press cells of monopolar design are not well known, probably because of the substantial practical problem of making electrical connections between the unit frames in the filter press and between one cell and the next. Tying all of the anodes together with a single electrical bus and tying all of the cathodes together with a single electrical bus interferes with drawing the frames together to form the seal between frames and membranes. On the other hand, use of flexible cables from cell to cell provides no way of removing one cell at a time from the circuit without interrupting the current for the entire circuit.

To illustrate the awkwardness of previous attempts to design monopolar membrane cells, reference is made to U.S. Pat. No. 4,056,458, by Pohto et al issued Nov. 1, 1977, to Diamond Shamrock Corporation. The Pohto et al patent discloses a cell which, like bipolar filter press cells, has the electrodes and end plates oriented perpendicular (see FIG. 8 of Pohto et al) to the overall path of current flow through the cell. Specifically, Pohto et al discloses a central electrode assembly sandwiched between two end electrode assemblies, with membranes in between, to form a closed cell. A plurality of central electrode assemblies apparently may also be sandwiched in a similar manner. The end compartment and each of the center compartments of the cell of Pohto et al are flanged and maintained paired by gaskets and fasteners holding flanges in pairs. This type of cell may be practical for small units producing several hundred pounds of chlorine per day, but it is not economically practical for plants which produce several hundred tons per day. For example, Pohto et al disclose connecting the cells to bus bars in a system which would only be suitable economically on a small scale. Specifically, electrode rods extend from the cell tops. This includes rods of both pluralities. If one tries to design such a bus system for a cell having a total current capacity of at least 150,000 amperes, which is a typical commercial cell current, the bus system will be found to be very large, cumbersome, and expensive. Monopolar filter press cells which have the electrodes oriented to provide a horizontal path of current flow through the cell have significant advantages over those providing a vertical current path through the cell. In these "side-stack" cells, the electrode elements and membranes are formed into a stack of "electrode packs" which are bolted between end frames. The end frames support the pack to form a convenient unit with respect to capacity, floor space, and portability. As the number of units in the stack are usually limited to less than about 25, problems with leakage are greatly reduced. Also virtually eliminated are problems with deformation of connecting bus bars due to temperature changes, which are serious with conventional filter press cells. Another advantage of the monopolar filter press cell is that, in case of failure of a membrane, only a single cell including about 20 membranes need be removed for dismantling, repair and reassembly. This is more economical than either taking out the entire filter press assembly on the one hand or providing an expensive arrangement for replacing individual membranes on the other hand. Still another advantage is that horizontally oriented electrode structures permit the construction of an extraordinarily high cell, while maintaining a short direct current path through the cell, thereby minimizing the amount of conductor material required for the cell and thereby minimizing voltage losses through the conductors of the cell. Yet another advantage of sidestack cells is that they employ intercell electrical connections which make taking a cell out of service relatively fast and simple.

Electrode structures for horizontally oriented diaphragm or membrane cells of the prior art include those of U.S. Pat. No. 3,963,596, issued June 15, 1976, to M. S. Kircher. This electrode structure has two electrode surfaces spaced apart and horizontal conductors positioned in the space between electrode surfaces. The conductors have a curved portion at one end. The horizontal conductors are connected directly to the electrode surfaces or to a gas directing element. The gas directing element is a channel-shaped structure attached to the sides of the electrodes surfaces and to the conductors. Having no openings, fluids contacting the conductors or the gas guiding elements are guided towards the curved end and then directed upward or downward into a channel or chimney area. These electrodes provide good fluid circulation for cells of moderate height, however as the height of the cell increases, the fluid velocity up the channel becomes excessive and undesired turbulence results.

It is an object of the present invention to provide a novel electrode for use in monopolar filter press cells for the production of chlorine and oxychlorine compounds.

Another object of the present invention is to provide a novel electrode for use in monopolar filter press cells having electrodes extending in a direction parallel to the path of current flow through the cell.

An additional object of the present invention is to provide an electrode having enhanced fluid flow through the interior of the electrode.

These and other objects of the invention are accomplished in an electrode for monopolar filter press cells which comprises:

(a) two vertical foraminous surfaces positioned in parallel and spaced apart, (b) a frame having two side members, a top member, and a bottom member attached to the foraminous surfaces, (c) a chamber formed between the foraminous surfaces and bounded by the frame, (d) conductor rods passing through one of the side members of the frame into the chamber, the conductor rods being spaced apart from the foraminous surfaces, (e) foraminous conductive connectors positioned in the chamber and attached to the conductor rods and to the foraminous surfaces, and (f) inlets and outlets in the frame for introducing fluids into and removing electrolysis products from the chamber.

Other advantages of the invention will become apparent upon reading the description below and the invention will be better understood by reference to the attached drawings in which:

FIG. 1 illustrates a front elevation of the electrode of the present invention with portions cut away.

FIG. 2 is an enlarged schematic partial sectional end view of the electrode of FIG. 1 taken along line 2—2 showing gas flow patterns through the foraminous connective conductor.

FIG. 3 depicts partial schematic end views of alternate embodiments a, b, c, and d of the foraminous conductive connectors.

FIG. 4 is a front elevational view of a monopolar filter press cell employing the electrodes of the present invention.

FIG. 5 is a side elevational view of the cell of FIG. 4 taken along line 5—5 of FIG. 4 and showing the anode side of the cell.

Electrode 10 of FIGS. 1 and 2 is comprised of vertical foraminous surfaces 14 and 16 positioned in parallel and spaced apart. Frame 24 is comprised of side members 26 and 28, top member 30, and bottom member 32. Foraminous surfaces 14 and 16 are attached to frame 24 to form chamber 18 between foraminous surfaces 14 and 16 and bounded by frame 24. Conductor rods 20 are positioned in chamber 18 and are spaced apart from foraminous surfaces 14 and 16. Foraminous conductive connectors 22 are attached to conductor rods 20 and foraminous surfaces 14 and 16 and supply electric current from conductor rods 20 to foraminous surfaces 14 and 16. Side member 26 has openings for conductor rods 20 which are electrically connected to electrode collectors 34 and 36 to which terminals 38 and 40 are attached. Guides 42 are included on frame 24 to allow for proper alignment with adjacent electrode frames. Gaskets or other sealant materials are suitably placed around the frame to permit a series of interleaved anode and cathode frames to be sealingly compressed to form monopolar filter press cell 60. Outlet 44 passes a cell gas produced to disengager 93 or 97 (see FIG. 4 or 5). Inlet 46 feeds a liquid into electrode 10.

FIG. 2 presents an enlarged schematic partial end view of the electrode of FIG. 1 in which foraminous conductive connectors 2 are attached to formanious surfaces 14 and 16 and conductor rod 20. Gas bubbles generated during the electrolysis process pass through openings in conductive connectors 22 and flow around conductor rod 20.

In FIG. 3A, the embodiment of foraminous conductive connectors 22, is rectangular shaped, and encloses conductor rod 20.

The embodiment of FIG. 3B includes an upper foraminous conductive connector above conductor rod 20 which is the inverted configuration of the lower conductive support.

FIGS. 3C and 3D show embodiments of foraminous conductive connectors which are attached along the sides of conductor rod 20.

The embodiments of FIGS. 3A, 3B, 3C, and 3D all provide controlled fluid flow up through the electrode.

FIG. 4 is a front elevational view of a monopolar filter press cell 60 which suitably employs the novel electrodes of the present invention as anodes.

FIG. 5 is also a view of cell 60 taken along line 5—5 of FIG. 4. FIGS. 4 and 5 should be viewed together and the reference numbers in both FIGURES refer to the same parts. Cell 60 comprises a front end plate 62, a rear end plate 64, a plurality of interleaved anode frames 24 and cathode frames 68; a plurality of tie bolts 70, an upper anode terminal 38, a lower anode terminal 40, an upper anode collector 34, a lower anode collector 36, an upper cathode terminal 80, a lower cathode terminal 82, an upper cathode collector and a lower cathode collector (not shown) and a material supply and withdrawal system 88. System 88, in turn, comprises a fresh brine supply conduit 90, spent brine withdrawal conduit 91, a chlorine outlet pipe 92, anolyte disengager 93, a water supply line 94, a caustic withdrawal line 95, a hydrogen outlet line 96 and a catholyte disengager 97. Chlorine outlet line 92 and hydrogen outlet line 96 are connected, respectively, to chlorine line 98 and hydrogen line 99 which, in turn, lead to chlorine and hydrogen handling systems (not shown).

Cell 60 is supported on support legs 100 and is provided with an anolyte drain/inlet line 46 and a catholyte drain/inlet line 102. Lines 46 and 102 can be valved drain lines connected to each frame 24 in order to allow anolyte and catholyte to be drained from anodes, and cathodes, respectively. Alternatively, lines 46 and 102 can also be connected to anolyte disengager 93 and catholyte disengager 97, respectively, in order to provide the recirculation path for disengaged anolyte and catholyte liquids.

Referring to FIGS. 1 and 5, where the electrode of the present invention is the anode, it is seen that the overall current flow path through cell 60 is horizontal, passing from anode terminals 38 and 40 to cathode terminals 80 and 82. Conductor rods 20 are anode conductor rods and receive current from anode terminals 38 and 40 via anode collectors 34 and 36. Conductor rods 20 supply current through foraminous conductive connectors 22 to anode surfaces 14 and then through the anolyte, the membrane, and the catholyte to the cathode surfaces. From the cathode surfaces, current is passed to cathode conductor rods and then to cathode collectors 84 and 86 to cathode terminals 80 and 82. Thus it is seen that current flows in a very straight and direct path with the only transverse flow occurring through the actual inter-electrode gap. In a series of cells, if an electrode frame or membrane of any one of the cells is damaged, it is a simple matter to bypass current around the cell containing the damaged frame or membrane while allowing the current to flow through the other cells. In this manner, a minimum amount of interruption in production results. In fact, a spare cell is preferably available and could be substituted for any disconnected cell which was removed for repair.

The novel electrodes of the present invention include a plurality of conductor rods. The conductor rods extend through a side of the electrode frame and into the chamber between the electrode surfaces. Within the chamber, the conductor rods are spaced apart from the foraminous surfaces. The conductor rods may be positioned substantially horizontal or sloped. One end of the conductor rods is attached to the electrode collectors. In another embodiment, the conductor rods have a first portion which is substantially horizontal for attachment to the electrode collectors and a second portion within the chamber which is sloped or curved. The shape or curvature of this second portion may be, for example, from about 1 to about 30, and preferably from about 2 to about 10 degrees from the horizontal, referenced from the horizontal portion for attachment to the electrode collectors. While the term conductor rod has been employed, the conductors may be in any convenient physical form such as rods, bars, or strips. While rods having a circular cross section are preferred, other shapes such as flattened rounds, elipses, etc. may be used.

Where the electrodes of the present invention are employed as anodes, for example, in the electrolysis of alkali metal chloride brines, the conductor rods are suitably fabricated from a conductive metal such as copper, silver, steel, magnesium, or aluminum covered by a chlorine-resistant metal such as titanium or tantalum. Where the electrodes serve as the cathodes, the conductor rods are suitably composed of, for example, steel, nickel, copper, or coated conductive materials such as nickel coated copper.

Attached to the conductor rods, for example, by welding, brazing, or the like, are foraminous conductive connectors which are also attached to the two electrode surfaces. Being positioned with the conductor rods between the electrode surfaces, the foraminous conductive connectors are attached along the side of the electrode surfaces not facing an adjacent oppositely charged electrode. As shown in FIGS. 2, 3A and 3B, the ends of the foraminous conductive connectors may be attached to opposite electrode surfaces or to the same electrode surface, as illustrated in FIGS. 3C and 3D. The foraminous conductive connectors conduct electric current from the conductor rods to the electrode surfaces and are thus selected to provide good electrical conductivity. The foraminous conductive connectors may be in various forms, for example, wire, mesh, expanded metal mesh which is flattened or unflattened, perforated sheets, and a sheet having slits, or louvered openings, with an expanded metal mesh form being preferred. Further, the foraminous conductive connectors need to provide sufficient free space to permit adequate fluid flow up through the electrode. For example, the open area of the mesh of the foraminous conductive connectors should be from about 0.2 to about 2 times the interior horizontal cross sectional area of the electrode, for example in a plane orthogonal to the interior surfaces of 14 and 16 of FIGS. 1–3.

It is desirable in selecting the form of the foraminous conductive connector that it be geometrically compatible with the form of the electrode surface so that suitable connections can be made.

Suitable configurations for the foraminous conductive connectors include "U" or "V" shaped curves which may be in the normal or upright position or inverted. A preferred configuration for the foraminous conductive connectors is an inverted "U" of the type illustrated in FIG. 2. This configuration collects rising gas bubbles and allows the collected gas to stream as larger bubbles upward through the openings. Because of its shape, gas evolution is directed toward the center of the channel and away from the membrane. Where, for example, the electrodes are employed as anodes in the electrolysis of alkali metal chloride brines, chlorine gas impingement against the membrane is detrimental to the life span of the membrane. In addition, gas rising along a curved surface of the underside of the conductor rod, in the restricted cross section area between the rod and the electrode surface, creates a Venturi effect by providing a low pressure zone. A flow of electrolyte inward through the electrode surfaces bounding this low pressure zone prevents the impingement of gas on the membrane both under and alongside of the conductor rods. While the embodiment in FIG. 2 shows a semicircular form of an inverted U, other forms including parabolic, elliptical, semi-octagonal, and semi-rectangular may be employed.

Embodiments of the foraminous conductor support shown in FIGS. 3A, 3B, 3C, and 3D are similarly suitable for restricting and directing gas flow in the chamber between electrode surfaces, particularly where some impingement of gas against the membrane can be permitted, for example, in a cathode where hydrogen gas is generated and released.

To promote suitable fluid flow up through the electrode chamber while minimizing turbulence, particularly in the upper portions of the electrode chamber, the size of the conductor rods and the openings in the foraminous conductor supports are selected to provide a superficial velocity of gas flow in the space between the conductor rod and the electrode surface in the range of from about 0.05 to about 1.00, and preferably from about 0.10 to about 0.50 meters per second.

Employing the novel electrodes of the present invention not only permits fluid flow up through the electrode chamber to be maintained at desired rates, but also allows the ratio of liquid to gas present in the fluid to be adjusted so that foam formation in the cell can be minimized or eliminated. For example, in the electrolysis of an alkali metal chloride brine such as sodium chloride, use of the electrode of the present invention permits the liquid portion of the fluid in, for example, the upper third of the electrode to be greater than 70 percent, preferably greater than 80 percent, and more preferably from about 85 to about 95 percent by volume of the fluid, chlorine gas being the other component.

Further, in an electrolytic cell in which the anolyte is fed through a downcomer to the bottom of the anodes, higher fluid pressures are normally also found in the bottom of the anodes. However, using the electrodes of the present invention, higher pressures are found, for example, at about one-half the electrode height. This is believed to be the result of a pumping action which occurs when the gas bubbles are compressed under each conductive connector, the bubbles coalesce and are released through the conductive connectors at a higher velocity, the velocity increasing at each stage.

The electrode surfaces for the electrode of the present invention are those which are employed in commercial cells, for example, for the production of chlorine and alkali metal hydroxides by the electrolysis of alkali metal chloride brines. Typically, where the electrode surfaces serve as the anode, a valve metal such as titanium or tantalum is used. The valve metal has a thin coating over at least part of its surface of a platinum group metal, platinum group metal oxide, an alloy of a platinum group metal or a mixture thereof. The term "platinum group metal" as used in the specification means an element of the group consisting of ruthenium, rhodium, palladium, osmium, iridium, and platinum.

The anode surfaces may be in various forms, for example, a screen, mesh, perforated plate, or an expanded vertical mesh which is flattened or unflattened, and having slits horizontally, vertically, or angularly. Other suitable forms include woven wire cloth, which is flattened or unflattened, bars, wires, or strips arranged, for example, vertically, and sheets having perforations, slits. or louvered openings.

A preferred anode surface is a foraminous metal mesh having good electrical conductivity in the vertical direction along the anode surface.

As the cathode, the electrode surface is suitably a metal screen or mesh where the metal is, for example, iron, steel, nickel, or tantalum, with nickel being preferred. If desired, at least a portion of the cathode surface may be coated with a catayltic coating such as Raney nickel or a platinum group metal, oxide, or alloy as defined above.

As shown in FIG. 1, frame 24 surrounds and encloses the electrode surfaces. It will be noted that, for example, the electrode frames are shown to be of picture-frame type configuration with four peripheral members and two parallel, planar, mesh surfaces attached to the front and back of the frame. These members could be in the shape of rectangular bars, circular tubes, elliptical tubes as well as being I-shaped or H-shaped. An inverted channel construction is preferred for the top member in order to allow the top member to serve as a gas collector. Preferably, this top inverted channel is reinforced at its open bottom to prevent bending, buckling, or collapse. The remaining members could be of any suitable configuration which would allow the frames to be pressed together against a gasket in order to achieve a fluid-tight cell. While a flat front and rear surface is shown for the members, it would be possible to have many other configurations such as round or even ridged channels. The electrode surface is shown in FIG. 1 to be welded to the inside of the peripheral members of the frame but could be welded to the front and back outside surfaces if the configuration of such outside surfaces did not interfere with gasket sealing when the electrode surfaces were on the outside rather than inside.

With the possible exception of the selection of materials of construction, frames 24 may be employed as anode frames or cathode frames in the electrodes of the present invention.

Membranes which can be employed with the electrodes of the present invention are inert, flexible membranes having ion exchange properties and which are impervious to the hydrodynamic flow of the electrolyte and the passage of gas products produced in the cell. Suitably used are cation exchange membranes such as those composed of fluorocarbon polymers having a plurality of pendant sulfonic acid groups or carboxylic acid groups or mixtures of sulfonic acid groups and carboxylic acid groups. The terms "sulfonic acid groups" and "carboxylic acid groups" are meant to include salts of sulfonic acid or salts of carboxylic acid which are suitably converted to or from the acid groups by processes such as hydrolysis. One example of a suitable membrane material having cation exchange properties is a perfluorosulfonic acid resin membrane composed of a copolymer of a polyfluoroolefin with a sulfonated perfluorovinyl ether. The equivalent weight of the perfluorosulfonic acid resin is from about 900 to about 1600 and preferably from about 1100 to about 1500. The perfluorosulfonic acid resin may be supported by a polyfluoroolefin fabric. A composite membrane sold commercially by E. I. duPont deNemours and Company under the trademark "Nafion" is a suitable example of this membrane.

A second example of a suitable membrane is a cation exchange membrane using a carboxylic acid group as the ion exchange group. These membranes have, for example, an ion exchange capacity of 0.5–4.0 mEq/g of dry resin. Such a membrane can be produced by copolymerizing a fluorinated olefin with a fluorovinyl carboxylic acid compound as described, for example, in U.S. Pat. No. 4,138,373, issued Feb. 6, 1979, to H. Ukihashi et al. A second method of producing the abovedescribed cation exchange membrane having a carboxyl group as its ion exchange group is that described in Japanese Patent Publication No. 1976-126398 by Asahi Glass Kabushiki Gaisha issued Nov. 4, 1976. This method includes direct copolymerization of fluorinated olefin monomers and monomers containing a carboxyl group or other polymerizable group which can be converted to carboxyl groups. Carboxylic acid type cation exchange membranes are available commercialy from the Asahi Glass Company under the trademark "Flemion".

Spacers may be placed between the electrode surfaces and the membrane to regulate the distance between the electrode and the membrane and, in the case of electrodes coated with platinum group metals, to prevent direct contact between the membrane and the electrode surface.

The spacers between the membrane and the electrode surfaces are preferably electrolyte-resistant netting having a spacing which is preferably about $\frac{1}{4}$ in both the vertical and horizontal directions so as to effectively reduce the interelectrode gap to the thickness of the membrane plus two thicknesses of netting. The netting also restricts the vertical flow of gases evolved by the electrode surfaces and drives the evolved gases through the mesh and into the center of the hollow electrodes. That is, since the netting has horizontal as well as vertical threads, the vertical flow of gases is blocked by the horizontal threads and directed through the electrode surfaces into the space between the electrode surfaces. With a $\frac{1}{4}''$ rectangular opening in the netting, the effective cell size in the interelectrode gap is reduced to about $\frac{1}{4}'' \times \frac{1}{4}$.

The novel electrodes of the present invention provide improved gas flow patterns by creating limited restrictions within the space between electrode surfaces of each electrode so as to generate a Venturi or low pressure effect which pulls the gases from the interelectrode gap through the electrode surfaces and into the interior of the electrodes. Placement of the conductor rods along the electrode surfaces provides for the electrode chamber to be divided into stages with construction of fluid flow between stages. This results in inhibiting pressure surges within the electrode and eliminates or significantly reduces turbulence.

The electrodes of the present invention are particularly suited for use in filter press cells employing electrodes which are from about 1 to about 5, meters high and 0.01 to about 0.15 meters thick, and preferably from about 1.5 to about 3meters high, and from about 0.04 to about 0.07 meters thick. The ratio of height to thickness is in the range of about 500:1 to about 5:1 and preferably from about 80:1 to about 20:1. For cells where the total number of anode frames and cathode frames in the pressed pack is in the range of from about 5 to about 50, this provides a ratio of height to thickness of at least about 1:2, and preferably at least 2:1. Significant increases in the ratio of units of product per area of floor space can be achieved with filter press cells of this type.

EXAMPLE

A monopolar filter press of the type of FIGS. 4 and 5 contained two anode and three cathode compartments interleaved. The cell was 1.10 meters high and 1.14 meters wide and had an electrode area of 4.0 square meters. The two anode compartments were of the type of FIG. 1 and each had three horizontal conductor rods (25 millimeters in diameter) spaced 0.34 meters apart. Foraminous conductive connectors of the configuration of FIG. 2 were welded to the bottom of each conductor rod and also welded to each of the inner sides of the electrode. The foraminous conductive connectors were diamond shaped and composed of unflattened titanium mesh 2.03 millimeters thick. The radius of the inverted "U" curve was 17.4 millimeters and the mesh was 52 percent open space. The conductor rods were spaced equidistantly from each electrode surface with the electrode surfaces being spaced apart 0.038 meters. Sodium chloride brine (210–220 grams NaCl per liter) at a temperature of 77° C. was electrolyzed employing a current density of 3 $KA/m^2$with a cell voltage of 3.75 volts. Chlorine gas produced in each of the anode compartments was discharged with entrained anolyte from the top of the compartments into an external gas-liquid disengager. Separated liquid plus added feed brine was returned to the bottom of each anode compartment. Ultrasonic flow meter measurements indicated the return flow to the first anode compartment was 1.6 liters per second. The calculated gas volume from this compartment was 2.5 liters per second. The superficial velocity of the fluid at the bottom and top of the anode compartment were calculated to be 3.6 and 9.4 centimeters per second, respectively. A pressure reading one third of the distance down from the top of the anode compartment indicated that the liquid fraction was 92 percent. The average liquid velocity was calculated to be 4 centimeters per second and the average gas velocity at 71 centimeters per second. An independent observation of the flow through a gas plate gave an estimated average liquid velocity of 5 centimeters per second at the bottom of the anode compartment and an average gas velocity of 75 centimeters per second at the top of the anode compartment. The flow of anolyte was calculated to be 0.27 liters per second per KA. No accumulation of foam was observed at the top of the cell and the foam level in the disengager was about 5 centimeters.

The novel electrode structure of the present invention employing the foraminous conductive connector maintained a high fraction of liquid in the upper portion of the anode compartment, a high rate of fluid flow per KA and efficient gas disengagement with a low level of foam in the disengager and no foam accumulation in the cell.

What is claimed is:

1. An electrode for a monopolar filter press cell which comprises:

(a) two vertical foraminous surfaces positioned in parallel and spaced apart, (b) a frame having two side members, a top member, and a bottom member attached to said foraminous surfaces, (c) a chamber formed between said foraminous surfaces and bounded by said frame, (d) conductor rods passing through one of said side members of said frame into said chamber, said conductor rods being spaced apart from said foraminous surfaces, (e) foraminous conductive connectors positioned in said chamber and attached to said conductor rods and to said foraminous surfaces, said foraminous conductive connectors being selected from the group consisting of "U", "V", semicircular, parabolic, elliptical, semioctagonal, or semirectangular, and (f) inlets and outlets in said frame for introducing fluids into and removing electrolysis products from said chamber.

2. The electrode of claim 1 in which said conductor rods are substantially horizontal.

3. The electrode of claim 2 in which said foraminous conductive connectors are comprised of a metal form selected from the group consisting of wire mesh, expanded metal mesh, perforated sheet, a slit sheet or louvered sheet.

4. The electrode of claim 2 in which said foraminous surfaces, said foraminous conductive connectors and said conductor rods are comprised of nickel or nickel alloys.

5. In a monopolar filter press cell for the electrolysis of salt solutions having a plurality of anodes and cathodes alternatingly interleaved and a cation exchange membrane between each anode and each cathode, the improvement which comprises employing as the cathodes the electrode of claim 4.

6. The electrode of claim 1 in which the configuration of said foraminous conductive connector is an inverted curve selected from the group consisting of "U", "V", semicircular, parabolic, elliptical, semioctagonal, or semirectangular.

7. The electrode of claim 1 or 5 in which both ends of said foraminous conductive connector are attached to one of said foraminous electrode surfaces.

8. The electrode of claim 1 or 5 in which one end of said foraminous conductive connector is attached to each of said two foraminous surfaces.

9. The electrode of claim 7 in which said foraminous conductive connectors are comprised of an expanded metal mesh.

10. The electrode of claim 9 having a height to width ratio of from about 500:1 to about 5:1.

11. The electrode of claim 7 in which said foraminous surfaces, said foraminous conductive connectors and said conductor rods are comprised of titanium.

12. In a monopolar filter press cell for the electrolysis of salt solutions having a plurality of anodes and cathodes alternatingly interleaved and a cation exchange membrane between each anode and each cathode, the improvement which comprises employing as anodes the electrode of claim 11.

13. The electrode of claim 1 in which said conductor rods have a first horizontal portion and a second sloped portion, said second sloped portion being positioned within said chamber.

14. The electrode of claim 1 in which the open area of said foraminous conductive connectors comprises from about 0.2 to about 2 times the interior horizontal cross sectional area of the electrode.

* * * * *